US012110171B2

(12) United States Patent
Bjerg

(10) Patent No.: US 12,110,171 B2
(45) Date of Patent: Oct. 8, 2024

(54) INTEGRATED FAN GRILLE FOR A COOLING MACHINE IN A REEFER CONTAINER

(71) Applicant: Maersk Container Industry A/S, Tinglev (DK)

(72) Inventor: Ole Haugstrup Bjerg, Rodekro (DK)

(73) Assignee: Maersk Container Industry A/S, Tinglev (DK)

( * ) Notice: Subject to any disclaimer, the term of this patent is extended or adjusted under 35 U.S.C. 154(b) by 1007 days.

(21) Appl. No.: 16/471,167

(22) PCT Filed: Dec. 14, 2017

(86) PCT No.: PCT/EP2017/082900
§ 371 (c)(1),
(2) Date: Jun. 19, 2019

(87) PCT Pub. No.: WO2018/114621
PCT Pub. Date: Jun. 28, 2018

(65) Prior Publication Data

US 2020/0017290 A1 Jan. 16, 2020

(30) Foreign Application Priority Data

Dec. 22, 2016 (DK) ..... PA 2016 71023

(51) Int. Cl.
*F25D 11/00* (2006.01)
*B65D 88/74* (2006.01)

(52) U.S. Cl.
CPC ..... *B65D 88/741* (2013.01); *F25D 11/003* (2013.01)

(58) Field of Classification Search
CPC .... B65D 88/741; B65D 88/744; B65D 88/74; F25D 11/006; F25D 23/006;
(Continued)

(56) References Cited

U.S. PATENT DOCUMENTS 3,893,244 A 7/1975 Danford
2008/0121107 A1* 5/2008 Pfannenberg ..... B01D 46/0005 96/417

(Continued)

FOREIGN PATENT DOCUMENTS

CN 1461725 A 12/2003
CN 101210569 A * 7/2008 ..... F04D 25/12

(Continued)

OTHER PUBLICATIONS

International Search Report and Written Opinion issued for the corresponding international application No. PCT/ EP2017/082900 mailed Apr. 3, 2019, 8 pages.

(Continued)

*Primary Examiner* — Harry E Arant
(74) *Attorney, Agent, or Firm* — EIP US LLP

(57) ABSTRACT

The invention relates to a back-plate for a cooling machine in a reefer container with an improved fan grille, where a grille or grating defines a section formed integral with the back-plate. The grille or grating defined in the back-plate can comprise layers of fibreglass forming the back-plate. The grille or grating can surround holes provided by drilling, cutting or another suitable machining of the back-plate after casting. The grille or grating can be provided by a mesh structure having different mesh sizes. The grille or grating can be provided with a more dense mesh structure in one or more local areas compared to a remaining part of the grille. The grille or grating is provided at an upper part of the back-plate.

14 Claims, 3 Drawing Sheets

(58) Field of Classification Search
CPC ..... F25D 11/003; F25D 17/067; F25D 2317/0681; B01D 46/00
See application file for complete search history.

(56) References Cited

U.S. PATENT DOCUMENTS

| | | | | |
|---|---|---|---|---|
| 2010/0251753 | A1* | 10/2010 | Thogersen | F25D 23/006 62/455 |
| 2017/0184333 | A1* | 6/2017 | Lukasse | B60H 1/321 |
| 2019/0178590 | A1* | 6/2019 | Vanberg | F28F 19/01 |

FOREIGN PATENT DOCUMENTS

| | | | | |
|---|---|---|---|---|
| CN | 101688723 | A | 3/2010 | |
| CN | 102478926 | A | 5/2012 | |
| CN | 104879977 | A | 9/2015 | |
| EP | 1911504 | A2 * | 4/2008 | B01D 46/0005 |
| EP | 2 180 276 | A1 | 4/2010 | |
| GB | 2 068 900 | A | 8/1981 | |
| GB | 2107443 | A * | 4/1983 | B60H 1/00464 |
| JP | H0446682 | U * | 4/1992 | |
| JP | 2008008517 | A | 1/2008 | |
| WO | 2004/080845 | A1 | 9/2004 | |

OTHER PUBLICATIONS

Chinese Office Action dated Oct. 30, 2020 for Chinese Application No. 201780078550.7.

* cited by examiner

INTEGRATED FAN GRILLE FOR A COOLING MACHINE IN A REEFER CONTAINER

FIELD OF THE INVENTION

The invention relates to a back-plate for a cooling machine in a reefer container with an improved fan grille.

BACKGROUND OF THE INVENTION

In cooling machines for reefer containers a fan opening is covered by a grille or grating made of stainless steel. The grille is mounted on a back-plate of the cooling machine inside the reefer container.

The grille is mounted on the back-plate covering a fan opening in order to avoid that a person unintentionally can get in touch with wings of the rotating fan and to avoid that parts of goods or packaging comes into contact with wings of the rotating fan.

The existing grille is made of stainless steel in order to achieve adequate strength, durability and cleaning. The cleaning is important to avoid growth of bacteria or germs. Here stainless steel has a suitable smooth surface to achieve easy cleaning.

A drawback can be that dirt can gather around fastening means and in joining between the back-plate and the fan grille.

Such a solution is disclosed by JP2008008517 A showing a separate panel (one of many) secured to the back-plate of the cooling machine in a reefer container by fasteners around the periphery of the panel.

SUMMARY OF THE INVENTION

These drawbacks are avoided by an integrated fan grille according to the invention, where the back-plate is formed in one piece and provided with holes for letting through an airstream to the fan.

The back-plate can be formed from fiberglass, fiber-reinforced plastic or cast from plastic material.

The back-plate is provided with a grille or grating defining a section formed integral with the back-plate.

Hereby the grille or grating is formed integral with the back-plate.

In an embodiment the back-plate can be provided with a grille or grating defined in the back-plate comprising layers of fibreglass forming the back-plate.

Further the back-plate can be provided with a grille or grating surrounding holes provided by drilling, cutting or another suitable machining of the back-plate after casting.

In an embodiment the grille or grating is provided by a mesh structure having different mesh sizes.

In an embodiment of the back-plate the grille or grating is provided with a more dense mesh structure in one or more local areas compared to a remaining part of the grille.

In an embodiment of the back-plate the grille or grating can have one or more local areas extending at least partly aligned with a fan.

In an embodiment of the back-plate the one or more local areas of the grille or grating extends longer in a width direction than in a height direction of the grille.

In an embodiment of the back-plate local areas are positioned symmetrical in relation to a vertical axis through a centre of the grille.

In an embodiment of the back-plate the grille or grating is provided at an upper part of the back-plate.

Hereby is achieved a back-plate having fewer parts, lower weight, less machining processes, lower risk of damage to cargo packaging material due to less sharp edges, materials overlaps and fasteners, no cracks/overlaps in joining where bacteria can propagate and therefore also easier cleaning.

Further is achieved that due to lower specific heat compared with stainless steel, condensation and thereby ice build-up is reduced in relation to the grille why de-icing time is also reduced.

Other advantages achieved by the invention can be that the back-plate and grille or grating due to forming of the grille or grating directly in the back-plate in such a way that the grille or grating is integrated in the back-plate leads to a back-plate and a fan grille or grating formed in one part. Hereby it is also possible to manufacture a back-plate with fan grille or grating having lower weight compared to prior art.

A number of further advantages can be less and easier machining processes, lower risk of damage to cargo packaging material due to less sharp edges, joining and fasteners and higher impact resistance compared to prior art.

Further embodiments and advantages are disclosed below in the description and in the claims.

BRIEF DESCRIPTION OF THE DRAWINGS

The invention will now be described more fully below, by way of example only, with reference to the accompanying drawings, in which.

DETAILED DESCRIPTION

Figure 1:
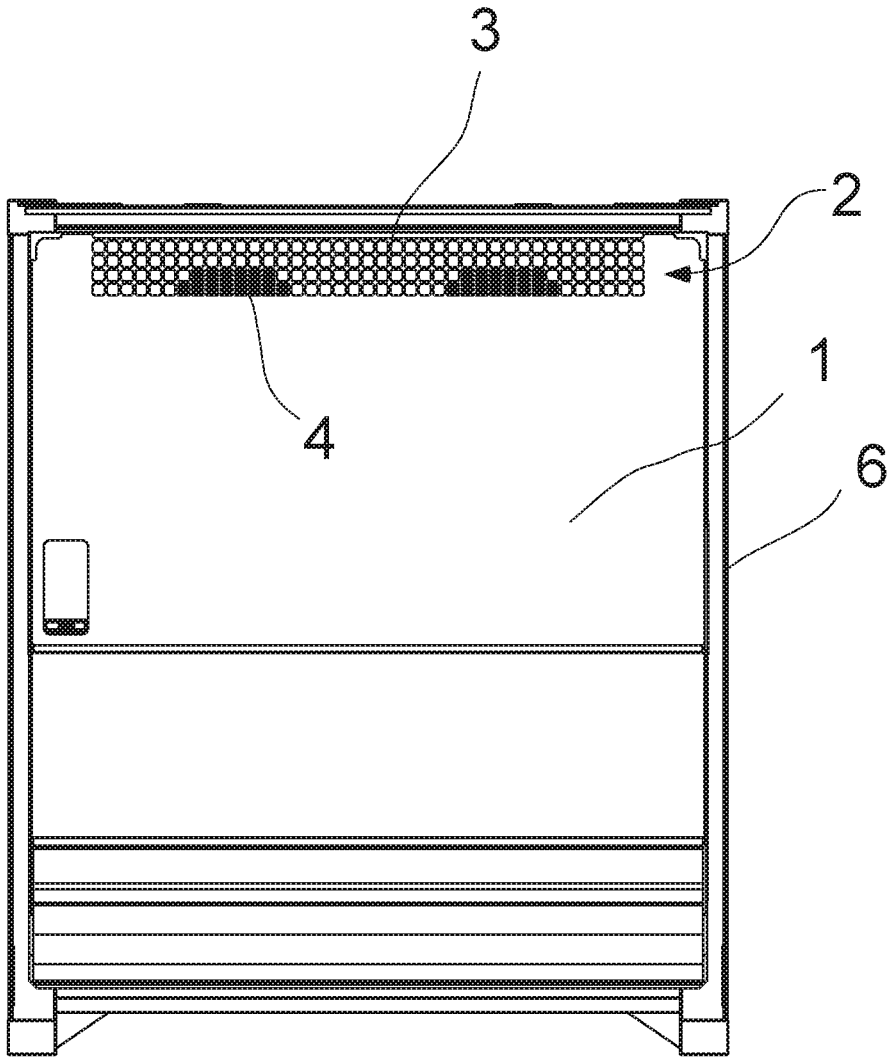
FIG. 1 shows a cooling unit for a reefer container from an end facing inside the container.
Figure 2:
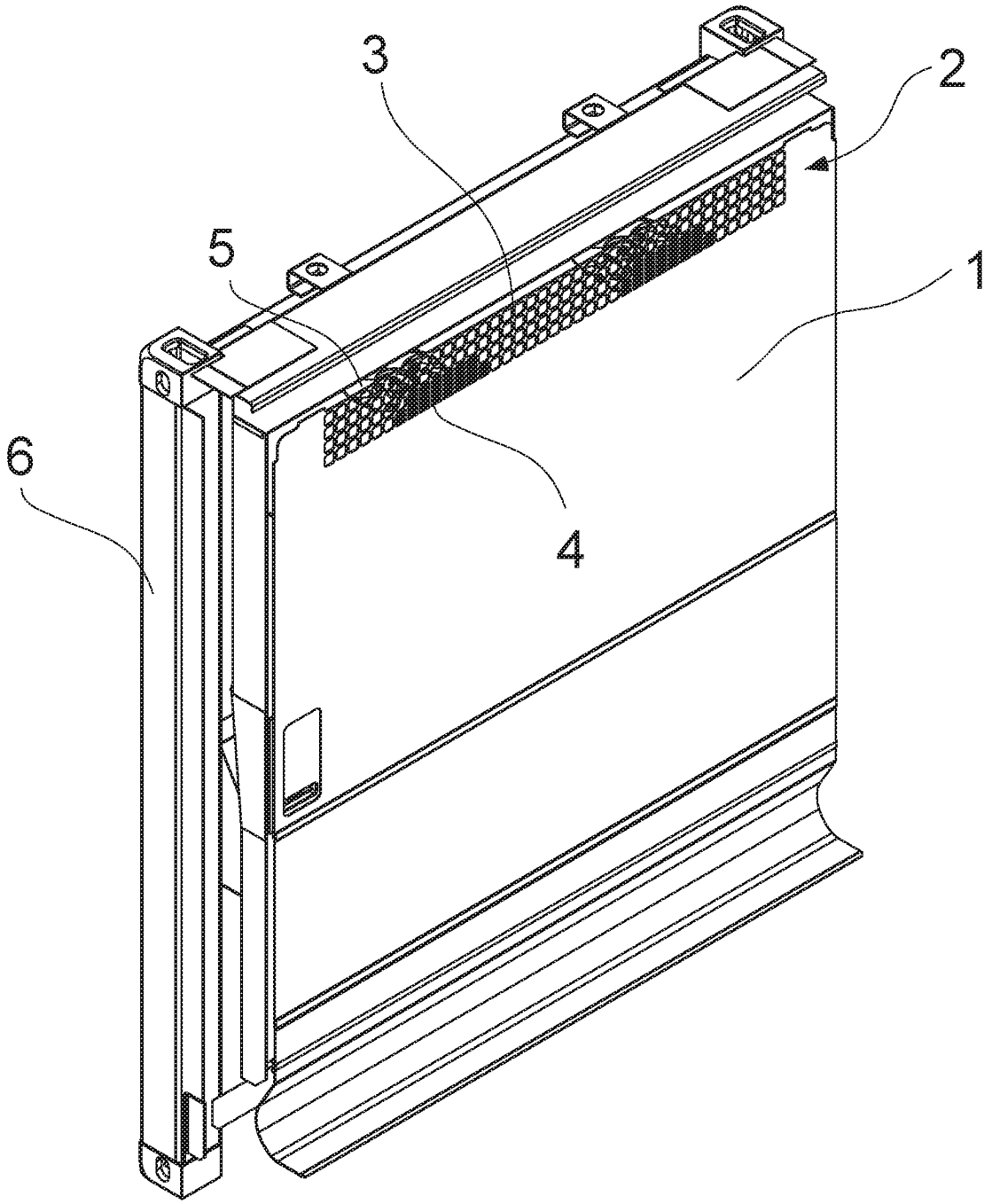
FIG. 2 shows the unit of FIG. 1 in a perspective view.
Figure 3:
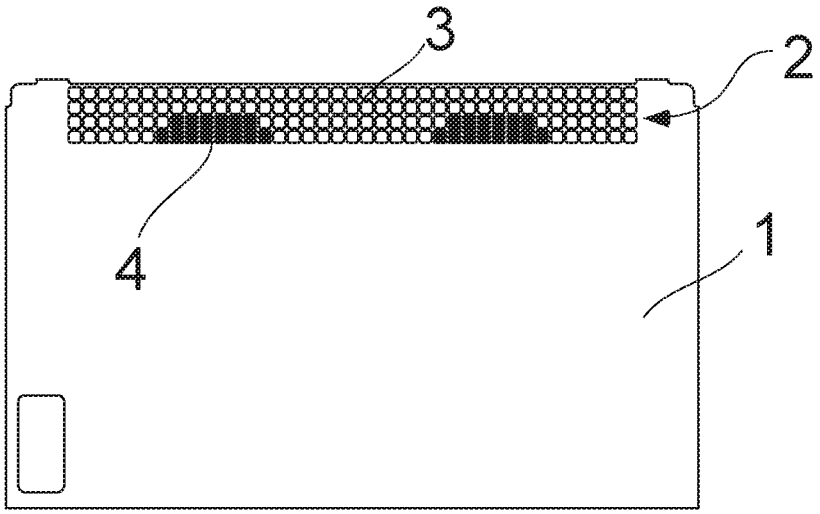
FIG. 3 shows a back-plate according to the invention.
Figure 4:
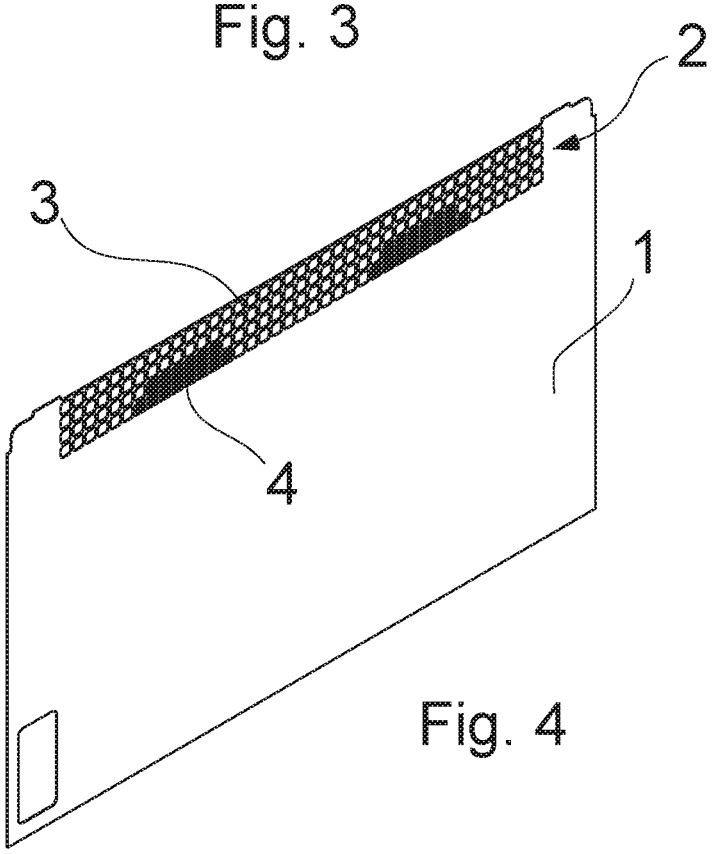
FIG. 4 shows the back-plate of FIG. 3 in a perspective view.

Now convenient embodiments of the invention will be described.

In a back-plate 1 for a cooling machine in a reefer container is provided a fan grille or grating 2. The back-plate 1 is mounted on one side of the cooling machine, which side is faced inside the reefer container thereby forming an end wall in a cooling compartment of the container.

The grille or grating 2 is formed integral with the back-plate where the grille or grating 2 defines a section of the back-plate 1.

Openings formed in the fan grille or grating 2 in the back-plate 1 forms a mesh structure 3. The openings can have different sizes and thereby form a mesh structure of different mesh sizes 3. In an area 4 close to rotating fan blades of the fans 5, the mesh size 3 of the grille or grating 2 is more dense and thereby more narrow openings compared to the rest of the mesh/openings 3 of the grille or grating 2. Hereby it is prevented that a person by accident can get his fingers in contact with the rotating fan 5 blades.

The cooling machine is mounted in a frame 6, which frame is fastened to one end of a reefer container opposite a door opening of the container or the frame 6 to which the cooling machine is mounted can be a part of the container structure.

In an embodiment the grille or grating 2 defined in the back-plate 1 comprises layers of fibreglass forming the back-plate 1. Here the layers of fibreglass are placed in such a way that web or the like from the layers is not covering the holes of the grille or grating 2, but forms the mesh 3 of the grille or grating 2.

The layers can be provided with cut-outs where the remaining fibreglass forms the mesh 3.

In an embodiment the grille or grating 2 surrounds holes, which holes are provided by drilling, cutting or another suitable machining of the back-plate 1 after casting.

In an embodiment the grille or grating 2 is provided with a more dense mesh structure in one or more local areas 4 compared to a remaining part of the mesh 3 of the grille 2.

In an embodiment the one or more local areas 4 extend at least partly aligned with a fan 5. Aligned should be understood as positioned in the mesh 3 close to a fan 5 and having an extent preventing a person from getting his fingers in contact with a rotating fan 5 blade.

In an embodiment the one or more local areas 4 extends longer in a width direction than in a height direction of grille 2.

In yet an embodiment the local areas 4 are positioned symmetrical in relation to a vertical axis through a centre of the grille 2.

In an embodiment the grille or grating 2 is provided at an upper part of the back-plate 1 where one or more evaporator fans 5 are placed to draw in return air in the cooling machine.

Having such an integrated grille or grating 2 with the back-plate 1 of a reefer container eliminates joints where bacteria or germs can propagate and thereby reduces need for exhaustive cleaning before next cargo enters the container.

The invention claimed is:

1. A cooling machine for a reefer container, the cooling machine comprising:

a back plate extending substantially in a plane and comprising a plurality of openings through the back plate, the plurality of openings thereby providing a grille or grating that is integrally formed with the back plate and that extends substantially in said plane; and one or more evaporator fans, operable to draw air from an interior of the reefer container into the cooling machine, through the grille or grating, and wherein: (i) the plurality of openings defines a mesh structure, which is more dense in one or more local areas compared to a remaining part of the mesh structure, (ii) each of the one or more local areas is at least partly aligned with at least one of the one or more evaporator fans and the remaining part of the mesh structure is not aligned with any of the one or more evaporator fans, (iii) the one or more evaporator fans comprise a first and a second evaporator fan, the grille or grating covering the first and second evaporator fans, (iv) each of the first and second evaporator fans is aligned with one of the one or more local areas, and (v) one or more of the plurality of openings are disposed between the first and second evaporator fans.

2. The cooling machine according to claim 1, wherein the grille or grating comprises layers of fibreglass forming the back-plate.

3. The cooling machine according to claim 1, wherein the one or more local areas extends longer in a width direction than in a height direction of the grille or grating.

4. The cooling machine according to claim 1, wherein the one or more local areas are positioned symmetrically in relation to a vertical axis through a centre of the grille or grating.

5. The cooling machine according to claim 1, wherein each of the one or more evaporator fans is rotatable about an axis perpendicular to said plane.

6. The cooling machine according to claim 1, wherein the cooling machine is configured to cool said air drawn from the interior of the reefer container into the cooling machine by the one or more evaporator fans.

7. A reefer container comprising:

a cooling compartment; and a cooling machine, comprising:

a back plate extending substantially in a plane and comprising a plurality of openings through the back plate, the plurality of openings thereby providing a grille or grating that is integrally formed with the back plate and that extends substantially in said plane; and one or more evaporator fans, operable to draw air from said cooling compartment into the cooling machine, through the grille or grating, and wherein: (i) the plurality of openings define a mesh structure, which is more dense in one or more local areas compared to a remaining part of the mesh structure, (ii) each of the one or more local areas is at least partly aligned with at least one of the one or more evaporator fans and the remaining part of the mesh structure is not aligned with any of the one or more evaporator fans, (iii) the one or more evaporator fans comprise a first and a second evaporator fan, the grille or grating covering the first and second evaporator fans, (iv) each of the first and second evaporator fans is aligned with one of the one or more local areas, and (v) one or more of the plurality of openings are disposed between the first and second evaporator fans.

8. The reefer container according to claim 7, wherein the grille or grating comprises layers of fibreglass forming the back-plate.

9. The reefer container according to claim 7, wherein the one or more local areas extends longer in a width direction than in a height direction of the grille or grating.

10. The reefer container according to claim 7, wherein the one or more local areas are positioned symmetrically in relation to a vertical axis through a centre of the grille or grating.

11. The reefer container according to claim 7, wherein the grille or grating is provided at an upper part of the back-plate.

12. The reefer container according to claim 7, wherein the back-plate is mounted on one side of the cooling machine, said side facing an inside of the reefer container thereby forming an end wall in the cooling compartment.

13. The reefer container according to claim 7, wherein each of the one or more evaporator fans is rotatable about an axis perpendicular to said plane.

14. The reefer container according to claim 7, wherein the cooling machine is configured to cool said air drawn from the interior of the reefer container into the cooling machine by the one or more evaporator fans.

* * * * *